United States Patent [19]

Gale et al.

[11] 4,228,672

[45] Oct. 21, 1980

[54] ROTARY NOTCHER AND FORMER

[75] Inventors: Leo R. Gale, Morton Grove; Robert R. Heilman, Elburn, both of Ill.

[73] Assignee: The Lockformer Company, Lisle, Ill.

[21] Appl. No.: 912,509

[22] Filed: Jun. 5, 1978

[51] Int. Cl.[3] ..... B21D 5/14

[52] U.S. Cl. ..... 72/130; 72/171; 83/356.3; 83/917

[58] Field of Search ..... 72/130, 132, 171, 172, 72/173, 129, 186; 83/355, 356.3, 501, 917

[56] References Cited

U.S. PATENT DOCUMENTS

| | | | |
|---|---|---|---|
| 3,157,079 | 11/1964 | Harper | 82/47 |
| 3,180,193 | 4/1965 | Benedict et al. | 83/355 |
| 3,186,281 | 6/1965 | Wingen | 83/501 X |
| 3,266,090 | 8/1966 | Gosney | 83/355 X |
| 3,427,847 | 2/1969 | Harper | 72/186 |
| 3,621,746 | 11/1971 | Womack | 83/501 |
| 3,982,457 | 9/1976 | Berry | 83/917 X |
| 4,115,000 | 9/1978 | Mischo et al. | 83/917 X |

FOREIGN PATENT DOCUMENTS

| | | | |
|---|---|---|---|
| 638323 | 11/1936 | Fed. Rep. of Germany | 72/170 |
| 162257 | 7/1920 | United Kingdom | 72/171 |
| 977602 | 12/1964 | United Kingdom | 72/171 |

*Primary Examiner*—Ervin M. Combs

*Attorney, Agent, or Firm*—McDougall, Hersh & Scott

[57] ABSTRACT

An apparatus for producing shaped metal objects such as collars for ventillating systems. The apparatus includes drive means for advancing a flat metal sheet past a rotary tool whereby notches are formed along one side of the sheet. The tool is provided with a stabilizing fitting and spring means to insure consistent notch forming. The notched sheet may be collected and formed into a rectangular configuration by other equipment or a removably attached sheet crimping and deflecting mechansim may be mounted in the path of movement of the notched sheet. This mechanism includes crimping rolls, and the deflecting means positioned beyond the crimping rolls operate to turn the sheet into a circular configuration whereby the product of the apparatus is automatically formed into a circular collar.

5 Claims, 10 Drawing Figures

ROTARY NOTCHER AND FORMER

BACKGROUND OF THE INVENTION

1. Field of the Invention

This invention is particularly related to the production of collars and the like which are particularly used in heating and ventilating systems. In such systems, heated or cooled air is introduced into ducts, and pipes are connected to the ducts at various positions for directing the air to individual rooms or areas. To accomplish this, holes are formed in duct walls, and connectors including rectangular or circular collars are attached at these holes. Pipe sections are then attached to the connectors.

2. Description of the Prior Art

In a typical connector design, an edge of the connector is provided with a plurality of spaced apart notches. The hole in the duct wall is dimensioned to receive this edge, and the tabs which are formed between the notches are then bent outwardly whereby the connector can be secured relative to the duct wall. The opposite side of the connector may be crimped for purposes of facilitating the attachment of a pipe section to the connector.

Equipment for producing connectors of the type described is readily available. Thus, notched edges can be formed in various ways, and crimping rollers are also well known constructions. The notching and crimping steps are thus independently conducted, and the order of the steps is not critical.

SUMMARY OF THE INVENTION

In accordance with this invention, an apparatus is provided for achieving the notching of metal sheets in a highly efficient manner. Furthermore, the apparatus includes means whereby a crimping operation may be conducted automatically in conjunction with the notching. Finally, the invention contemplates the automatic production of cylindrical collars of any desired size whereby a flat sheet may be introduced to one end of the apparatus, and a cylindrical collar construction including the desired notching and crimping will exit from the apparatus.

The apparatus includes a rotary tool mounted on a shaft along with sheet advancing means for driving a sheet edge adjacent the rotary tool. The tool is characterized by a stabilizing structure whereby the tool operation is both accurate and efficient. The sheet advancing means serves to continuously expose unnotched sheet edge portions to the tool whereby the desired notches are automatically formed.

A crimping device, for example in the form of opposed crimping rollers, is removably mounted beyond the notching means. Deflecting means associated with the crimping device serve to turn the sheet into a circular configuration as the sheet exits from the crimping device. By selecting sheets of predetermined length and by positioning the deflecting means in a corresponding predetermined position, the apparatus of the invention will automatically produce cylindrical collars which are notched along one edge and which are also crimped. The apparatus thus provides a single machine for producing connectors in the manner described.

DESCRIPTION OF THE PREFERRED EMBODIMENT

Figure 1:
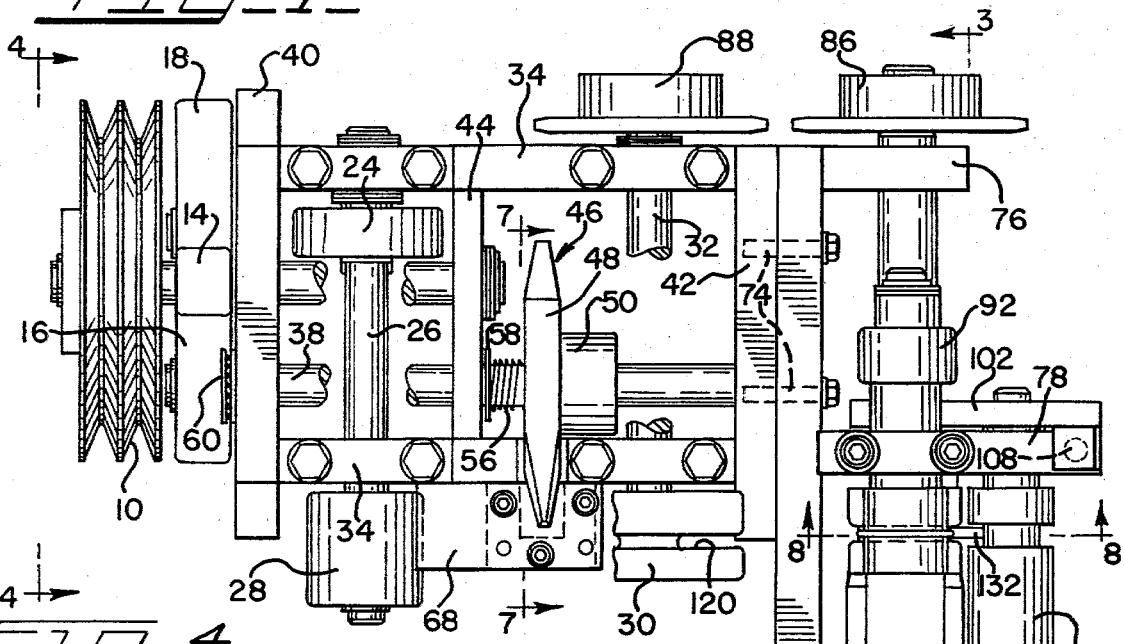
FIG. 1 is a plan view of a sheet notching and crimping apparatus characterized by the features of this invention.
Figure 4:
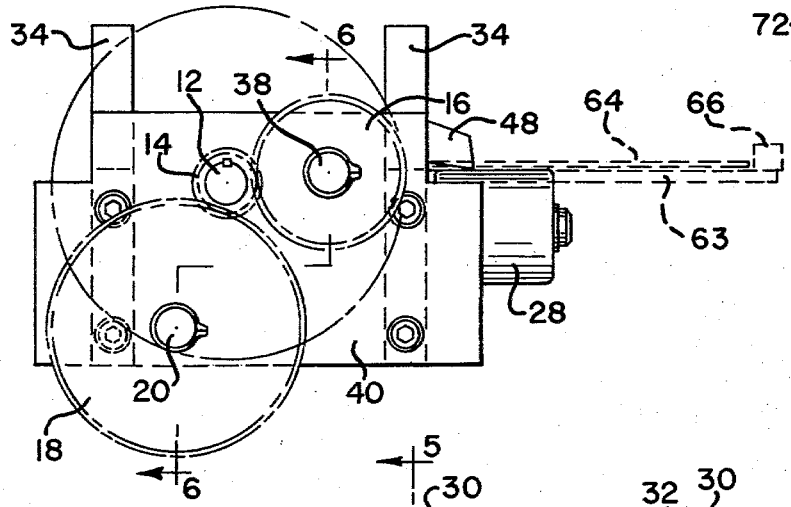
FIG. 4 is an end view of the apparatus taken about the line 4—4 of FIG. 1.
Figure 2:
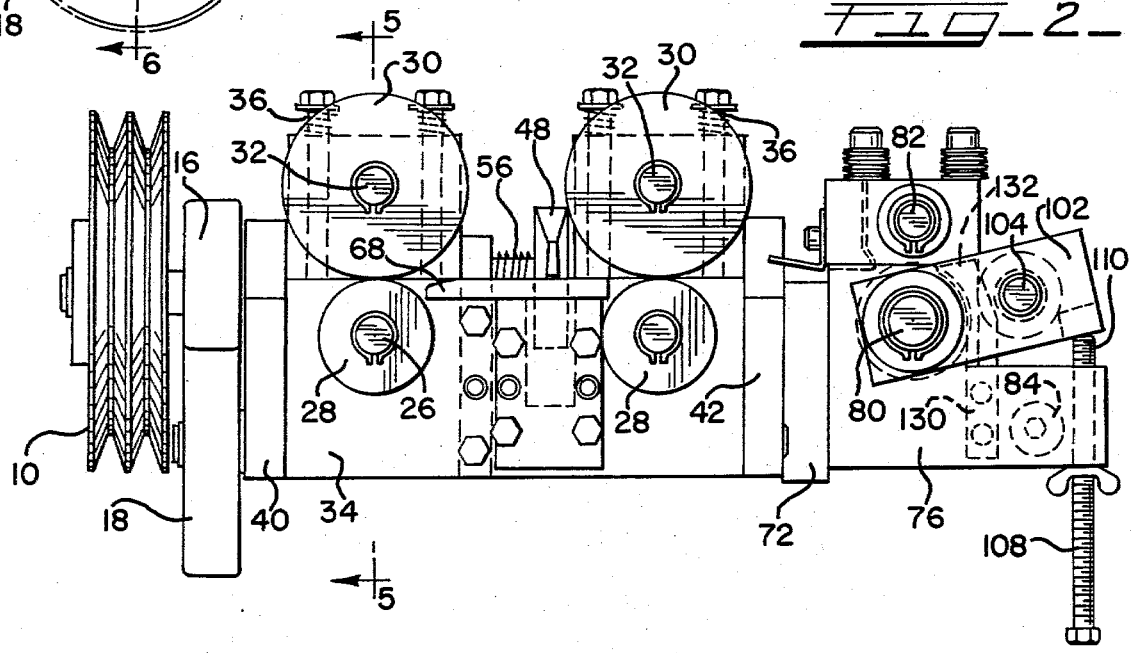
FIG. 2 is a side elevation of the notching and crimping apparatus.
Figure 3:
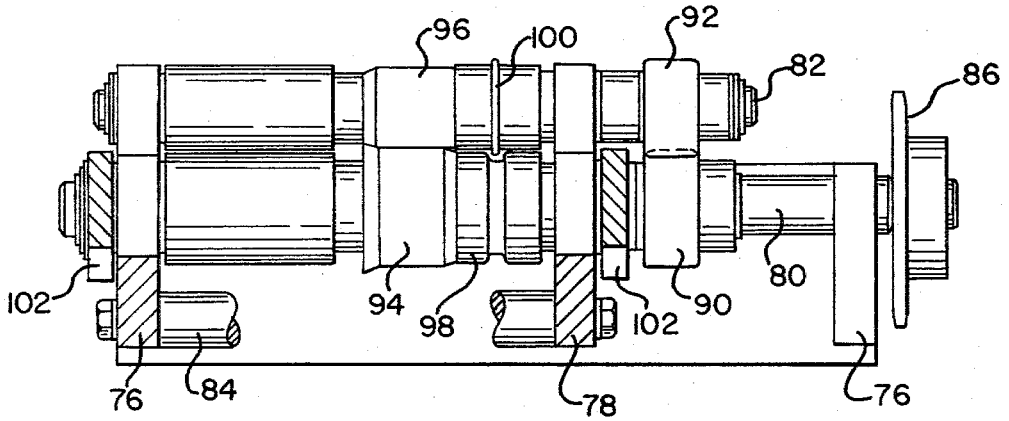
FIG. 3 is an end view of the apparatus taken about the line 3—3 of FIG. 1.

The apparatus of the invention includes a drive pulley 10 mounted on shaft 12 for rotating gear 14 which meshes with gears 16 and 18. The gear 18 drives shaft 20 which supports worm 22, this worm in turn meshing with gear 24. The shaft 26 driven by gear 24 supports sheet drive roller 28. Idler roller 30 is supported on shaft 32 extending between side frames 34. These side frames are urged downwardly by springs 36 whereby the roller 30 is pressed into engagement with each sheet entering the apparatus.

A second pair of drive rollers 28 and 30 are provided, and a corresponding gear 24 meshing with worm 22 may be associated with these rolls. It will be appreciated that the described mechanisms for advancing sheets through the apparatus are conventional and do not form a part of the invention.

The drive gear 16 is mounted on shaft 38 which extends between transverse frame members 40 and 42. This shaft is also supported by bearings of intermediate frame member 44, and the shaft is provided for supporting rotary tool 46.

The tool 46 includes rotary blade 48 and an associated fitting 50. This fitting is secured to the blade by means of bolts 52 and a retaining ring 54 secures the assembly of the fitting and blade against axial movement along shaft 38. A compression spring 56 extends around shaft 38. One end of the spring bears against blade 48, and the other end of the spring bears against washer 58 positioned adjacent intermediate frame member 44. Since the frame member 44 comprises a fixed portion of the apparatus, the spring 56 constantly presses against the blade 48. A rotary thrust bearing 60 is associated with the shaft 38 in the area of frame 40. Accordingly, forces exerted by the spring 56 are applied to this thrust bearing. A standard locking ring 62 secures the shaft 38 against displacement inwardly against the action of spring 56.

A supporting table 63 of conventional design may be utilized for sheet 64 fed to the apparatus. The inner edge of the sheet may bear against wall 34 or a suitable gauge block attached in this area. An outboard gauge block 66 may also be provided.

The plate 68 may be formed integrally with or attached as a part of the table 63. This plate defines an opening 70 for entry of blade 48 as the blade rotates. It will be appreciated that this provides for the formation of notches along a sheet edge, the notches being spaced apart in accordance with the advancing speed of the sheet being formed. The configuration of the blade will depend upon the type of notch desired, and this may comprise any one of standard configurations known in the art.

A supporting plate 72 is attached by means of fasteners 74 to the frame member 42. This support carries side frame members 76 and an intermediate frame member 78. Upper and lower shafts 80 and 82 are supported by these frame members. Connecting rod 84 secures one frame end 76 to the intermediate frame 78.

A drive sprocket 86 is mounted on shaft 80, and a suitable chain is provided for connecting this sprocket to sprocket 88 supported on shaft 32. Since this shaft 32 is driven by gear 22, the respective sprockets will serve to drive shaft 80 from the main drive of the apparatus. Shaft 80 carries gear 90 meshing with gear 92 supported by shaft 82 so that the shafts 80 and 82 are driven in unison.

The shafts 80 and 82 carry, respectively, interacting crimping rollers 94 and 96. In addition, bead forming rollers 98 and 100 are carried by the respective shafts.

The intermediate frame member 78 and one end frame member 76 also support a pair of shaft mounting plates 102. Shaft 104 is supported for rotation by these plates, and deflecting roller 106 is supported on this shaft.

Each of the plates 102 defines an opening shaft 80, and these plates are pivotal about the shaft 80. Adjusting screws 108 define engaging ends 110, and these ends engage inwardly extending portions 112 of the plates 102. It will be appreciated that by rotating the adjusting screws, the angular position of the plates 102 will be changed whereby the position of the deflecting roller 106 can be adjusted.

An arbor 130 is positioned between the deflecting roll 106 and the crimping means. This arbor includes an upper end 132 which serves to engage the leading edges of each sheet immediately upon passage of these edges from between the crimping rolls. The arbor includes an upwardly tapered surface whereby the leading edges are deflected toward the periphery of the deflecting roll 106. It has been found that the use of the arbor eliminates a flat end portion at the leading edges of each sheet, this flat developing due to the fact that the leading edge travels a short distance before engaging the deflecting roll 106. The arbor design spans this distance, and it is preferred that the arbor fasteners 134 be located in slots defined by frame member 78 so that the arbor can be adjusted in accordance with adjustments in the position of the deflecting roll.

Figure 10:
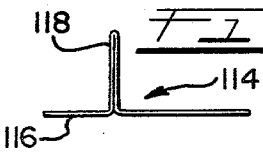

In the use of the apparatus of the invention, the support 72 may be reduced whereby a sheet fed to the apparatus will be engaged by the tool 46 for notching of the sheet and will then be passed from the apparatus without further forming. FIG. 10 illustrates a sheet 114 which has a cross section typical of sheets employed for forming rectangular connectors. In this case, the edge 116 of the sheet will be engaged by the notching tool. The intermediate section 118 of the sheet is provided as a strengthening rib and as a limit means in conventinal fashion, and the groove 120 defined by roller 30 is provided to accommodate this design. The forming of the rib is not a part of the invention.

Figure 9:
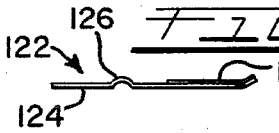
FIG. 9 is an end view of a sheet formed in accordance with the practice of the invention; and, FIG. 10 is an end view of an alternative form of a sheet formed in accordance with the practice of the invention.

With the support 72 and associated rollers in place, a cross section as provided by the sheet 122 in FIG. 9 will be produced. This structure includes a notched edge 124, an intermediate bead 126, and a crimped section 128. The structure is provided by feeding a flat sheet into the apparatus whereby one edge of the sheet is engaged by the notching tool 46. As the drive means advance the sheet, notches are formed in spaced relationship, it being understood that the spacing can be controlled by controlling the drive mechanisms. It will be noted, however, that since the tool 46 is driven by the same means as the advancing rolls, variations in the main drive speed will cause variations in both the sheet advancing speed and rotary tool speed. The ratio of the variations will depend upon the gear ratios involved and may be readily controlled.

Sheets passing beyond the notching tool are automatically fed to the bead forming and crimping rolls. Accordingly, the sheets produced will achieve the configuration of FIG. 9 in a single pass through the apparatus.

It is contemplated that the sheets so-formed be bent into a rectangular configuration on separate forming equipment or that other configurations suitable for collar connectors be obtained utilizing other equipment. The provision of deflecting means of the type described provides, however, for the automatic formation of collar connectors of a circular configuration. Furthermore, the radii of the connectors can be readily controlled with the described apparatus.

Figure 8:
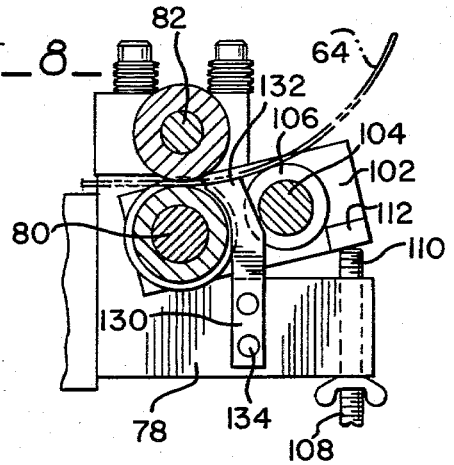
FIG. 8 is a fragmentary, cross-sectional view taken about the line 8—8 of FIG. 1.
Figure 5:
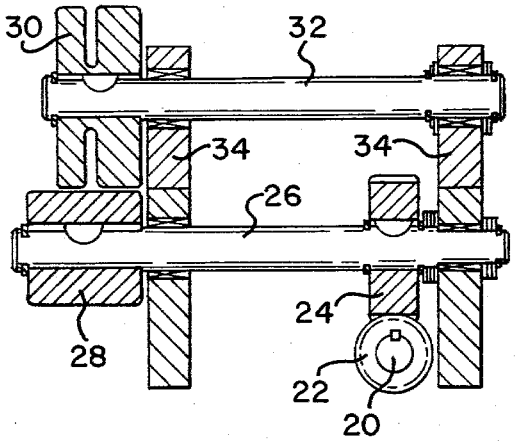
FIG. 5 is a vertical, cross-sectional view taken about the line 5—5 of FIG. 2.
Figure 7:
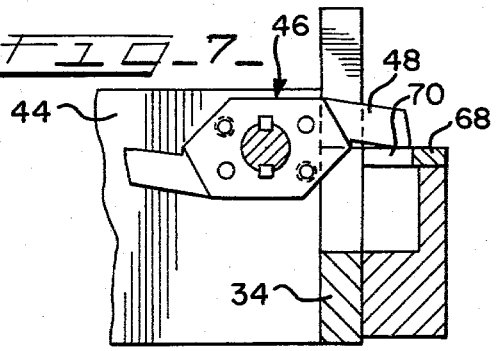
FIG. 7 is a fragmentary, cross-sectional view taken about the line 7—7 of FIG. 1.
Figure 6:
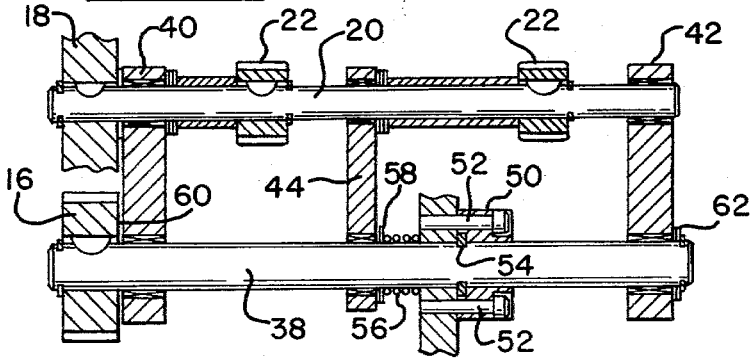
FIG. 6 is a vertical, cross-sectional view taken about the line 6—6 of FIG. 4.

The operation of the arbor 130 and deflecting roll 106 is best illustrated in FIG. 8. As indicated, a sheet edge exiting from bottom crimping rolls 80 and 82 will be deflected upwardly at an angle determined by the position of roller 106. As the sheet feeding continues, the deflecting means automatically cause the sheet to curve and eventually a complete circle will be achieved. By controlling the degree of curvature in accordance with the length of the sheet introduced, circular collars of various radii are produced. The machine can thus be readily adjusted for purposes of producing collars of different sizes, particularly standard sizes utilized in the trade.

The operation can be carried out at relatively high speeds since the notching and forming functions are uncomplicated operations. Even relatively unskilled operators can insert the flat sheets required and manually remove the finished product. It is also contemplated that automatic means be employed for collecting the collars produced.

It will be understood that various changes and modifications may be made in the above described apparatus without departing from the spirit of the invention, particularly as described in the following claims.

That which is claimed is:

1. In an apparatus for forming collars from sheet metal, the apparatus having means for producing a plurality of spaced apart notches in the edge of a sheet, and wherein means are provided for advancing the sheet through the apparatus, the improvement in means for forming the notches comprising a rotary tool having at least one end engageable with said sheet, a shaft supporting said tool, and drive means connected to said shaft for rotating the shaft and tool whereby said end is engaged with said sheet, the means for advancing the sheet operating to continually expose unnotched sheet edge portions to said tool whereby new notches are formed as the tool revolves, and tool stabilizing means engaging said tool during rotation, said stabilizing means comprising a fitting attached to said tool, said fitting being fastened to said tool for rotation therewith, said fitting extending around and along said shaft on at least one side of said tool, a stationary frame portion in spaced relationship with said tool, spring means extending between said frame portion and said tool, securing means holding said tool and associated fitting against axial movement relative to the shaft, said spring means comprising a compression spring positioned around said shaft and having one end bearing against said frame portion and the other end bearing against said tool, said spring means therefore forcing said shaft in a direction away from said frame portion, and including a thrust bearing associated with said shaft at one end of the shaft, said one end being located on the side of the frame portion opposite the location of said spring whereby the force generated by said spring is transmitted to said thrust bearing.

2. An apparatus in accordance with claim 1 including a support removably attached adjacent said tool, and crimping means mounted on said support, said means for advancing the sheet delivering the notched sheet automatically to said crimping means.

3. An apparatus in accordance with claim 2 including sheet deflecting means mounted on said support, said sheet engaging said deflecting means after passage from said crimping means, said deflecting means bending the sheet into a substantially circular configuration.

4. An apparatus in accordance with claim 3 wherein said deflecting means comprise at least one roll mounted adjacent said crimping means, pivotal mounting means for said roll, and means for adjusting said mounting means to control the elevation of said roll relative to the sheet passing from the crimping means.

5. An apparatus in accordance with claim 4 wherein said crimping means comprise upper and lower forming rolls, and including an arbor interposed between the crimping rolls and the roll of said deflecting means, said arbor being positioned to engage said sheet as the sheet exits from the nip of the crimping rolls whereby the leading edge portion of the sheet is deflected by the arbor to achieve curvature of the leading edge portion of the sheet.

* * * * *